US009841160B2

(12) United States Patent
Magras-Sinnen et al.

(10) Patent No.: US 9,841,160 B2
(45) Date of Patent: Dec. 12, 2017

(54) DECORATIVE CANDLE SLEEVE AND INTERLOCKING CONNECTORS FOR SHEETS

(71) Applicant: MinMor Industries, LLC, Brooklyn Center, MN (US)

(72) Inventors: Jacqueline A. Magras-Sinnen, Maple Grove, MN (US); Jeffrey T Murphy, Chanhassen, MN (US); Joel O Morris, Roseville, MN (US)

(73) Assignee: MinMor Industries, Brooklyn Center, MN (US)

( * ) Notice: Subject to any disclaimer, the term of this patent is extended or adjusted under 35 U.S.C. 154(b) by 131 days.

(21) Appl. No.: 14/972,871

(22) Filed: Dec. 17, 2015

(65) Prior Publication Data

US 2016/0178156 A1 Jun. 23, 2016

Related U.S. Application Data

(60) Provisional application No. 62/094,257, filed on Dec. 19, 2014, provisional application No. 62/182,929, filed on Jun. 22, 2015.

(51) Int. Cl.

| | |
|---|---|
| ***F21V 1/22*** | (2006.01) |
| ***F21V 1/14*** | (2006.01) |
| ***F21V 17/00*** | (2006.01) |
| *F21W 121/00* | (2006.01) |

(52) U.S. Cl.

CPC ..... *F21V 1/146* (2013.01); *F21V 17/007* (2013.01); *F21V 1/22* (2013.01); *F21W 2121/00* (2013.01)

(58) Field of Classification Search

CPC ..... F21V 17/007; F21V 35/00

See application file for complete search history.

(56) References Cited

U.S. PATENT DOCUMENTS

| | | | | | |
|---|---|---|---|---|---|
| 736,506 | A * | 8/1903 | Du Ket | G09F 13/00 | 362/806 |
| 1,477,991 | A * | 12/1923 | Baker | F21V 1/18 | 362/360 |
| 5,051,879 | A * | 9/1991 | Bunger | A47G 33/0836 | 362/351 |
| 5,264,996 | A * | 11/1993 | Bele, Jr. | F21S 13/00 | 229/108.1 |
| 5,597,230 | A * | 1/1997 | Newman | A45C 15/06 | 362/154 |
| 5,598,652 | A * | 2/1997 | Nurre | G09F 13/00 | 362/412 |
| 5,791,774 | A * | 8/1998 | Briles | F21S 6/001 | 362/153 |
| 6,033,089 | A * | 3/2000 | Tesauro | F21V 3/00 | 362/124 |

(Continued)

*Primary Examiner* — Daniel J Wiley

(57) ABSTRACT

A decorative sleeve for receiving or placing around a light source such as a traditional or flameless candle. The sleeve includes a flexible sheet of translucent or transparent material having a surface image thereon and having opposing first and second edges and a locking system. The locking system is configured to smoothly connect the first and second edges to form the sheet into a sleeve configuration. The locking system may be disconnected by a user to allow for flat storage of the sheet, and then may be reconnected by the user at a later time when the sleeve is used again.

4 Claims, 17 Drawing Sheets

(56) References Cited

U.S. PATENT DOCUMENTS

| | | | | | |
|---|---|---|---|---|---|
| 6,152,579 | A * | 11/2000 | Reed | F21V 7/10 | 362/297 |
| 6,685,345 | B1 * | 2/2004 | Velasquez | F21S 6/001 | 362/356 |
| 7,314,293 | B2 * | 1/2008 | Steier | F21S 6/00 | 362/351 |
| 7,399,091 | B2 * | 7/2008 | Lockett | F21V 1/00 | 353/120 |
| 8,777,445 | B2 * | 7/2014 | Gourdie | F21S 6/001 | 362/190 |
| 9,022,277 | B2 * | 5/2015 | Hendricks | B65D 71/16 | 229/185 |
| 2007/0257594 | A1 * | 11/2007 | Cayton | A63H 27/10 | 313/324 |
| 2010/0046240 | A1 * | 2/2010 | Marden | F21S 6/001 | 362/392 |

* cited by examiner

DECORATIVE CANDLE SLEEVE AND INTERLOCKING CONNECTORS FOR SHEETS

BACKGROUND

Candles are available in a variety of diameters and heights and include traditional flame candles having a wax and wick as well as flameless candles, such as electrical candles like LED candles. Some are able to stand independently, while others require a holder. For example, pillar type candles are wide cylindrical candles having various heights. The extreme wide nature of pillar candles allows the candle to burn for an extended period of time and they are widely used as light sources and scent sources for various parties and events due to their long burning nature. Further, the wide base of these candles makes them less likely to tip over. Other candles which may be similarly self-supporting include short wide candles such as tea lights.

Pillar candles have a larger mass and are thus more visible when used, but pillar and other candles have limited aesthetic appeal. Likewise, candles of other sizes, including traditional and flameless candles, as well as other light sources, can also have limited aesthetic appeal. Candles and other light sources may be decorative only in the sense that the wax or other material may be colored other a shade of white or cream. In some instances, candles may have a small decorative twine garland with an ornament of some type secured around a section of the candle. Alternatively, a decorative element can be added by way of a decorative holder, dish or plate placed under the candle or other light source.

This sheets may be used for various purposes. However, systems for interconnecting two sheet edges, whether used for decorative purposes or other functions, can be cumbersome to engage. In some cases, the connection may be permanent, preventing disengagement and later reuse. In other cases, particularly when the material is plastic, the interconnection can result in buckling and a less than smooth appearance that detracts from the visual appeal.

SUMMARY

Various embodiments include decorative sleeves for receiving or placing around a light source. In some embodiments, the decorative sleeve is a flexible sheet of translucent or transparent material having a surface image thereon. The sheet has opposing first and second edges and a locking system to smoothly connect the first and second edges to form the sheet into a sleeve configuration. The locking system can further be disconnected to allow for flat storage of the sheet, and then can be connected again to form the sleeve at a later time. The sleeve is self-supporting and may be tubular or conical in shape.

The locking system may be formed only from the sheet material itself, with no additional components. In some embodiments, the locking system includes a first locking member adjacent to the first edge and a second locking member adjacent to the second edge. The first locking members is configured to align with and connect with the second locking member when the sheet is formed into the sleeve configuration. In some embodiments there are a plurality of first and second locking members. In some embodiments, the first locking member is a tab extending from the first edge and the second locking member is an elongated aperture adjacent to the second edge. The first locking member further include an aperture within the tab.

The flexible material may be a thin and flexible plastic. IN some embodiments, it is an opaque plastic, which may be colorless and which may simulate the appearance of frosted glass when used surrounding a light source such as a candle.

In some embodiments, the sheet includes an aperture configured to permit the unblocked passage of light when the sleeve is placed around a light source. For example, when the image on the decorative sleeve is a face, the aperture may form an eye of a face.

In some embodiments, the image is reverse printed on a surface of the sheet which forms the inside of the sleeve when in the sleeve configuration, such as when an opaque plastic or lenticular material is used.

In some embodiments, the decorative sleeve is provided with one or more self-adhesive decorative elements allowing the user to decorate the sleeve.

In still other embodiments, the sheet includes guideline markings to guide a user to cut the sheet and reduce its size by removing the third and/or fourth edges of the sheet, such as by removing the edges symmetrically.

Other embodiments include the locking system itself, which may be used for various purposes, such as to connect elements of a diorama to a base in perpendicular orientation, or the form the closure of box.

DETAILED DESCRIPTION

The present disclosure is directed to a sleeve having an open top and bottom and configured to cover a light source such as a candle or similar illuminable unit therein, and to closures for use in decorative sleeves and with other sheets. The sleeve is further adapted with decorative elements including a design or various images integrated therein or thereon and/or to have decorative elements added to it by a user. The application claims priority to U.S. patent application No. 62/182,929 filed Jun. 22, 2015 and U.S. patent application No. 62/094,257 filed Dec. 19, 2014, the disclosures of both of which are incorporated by reference.

Figure 1:
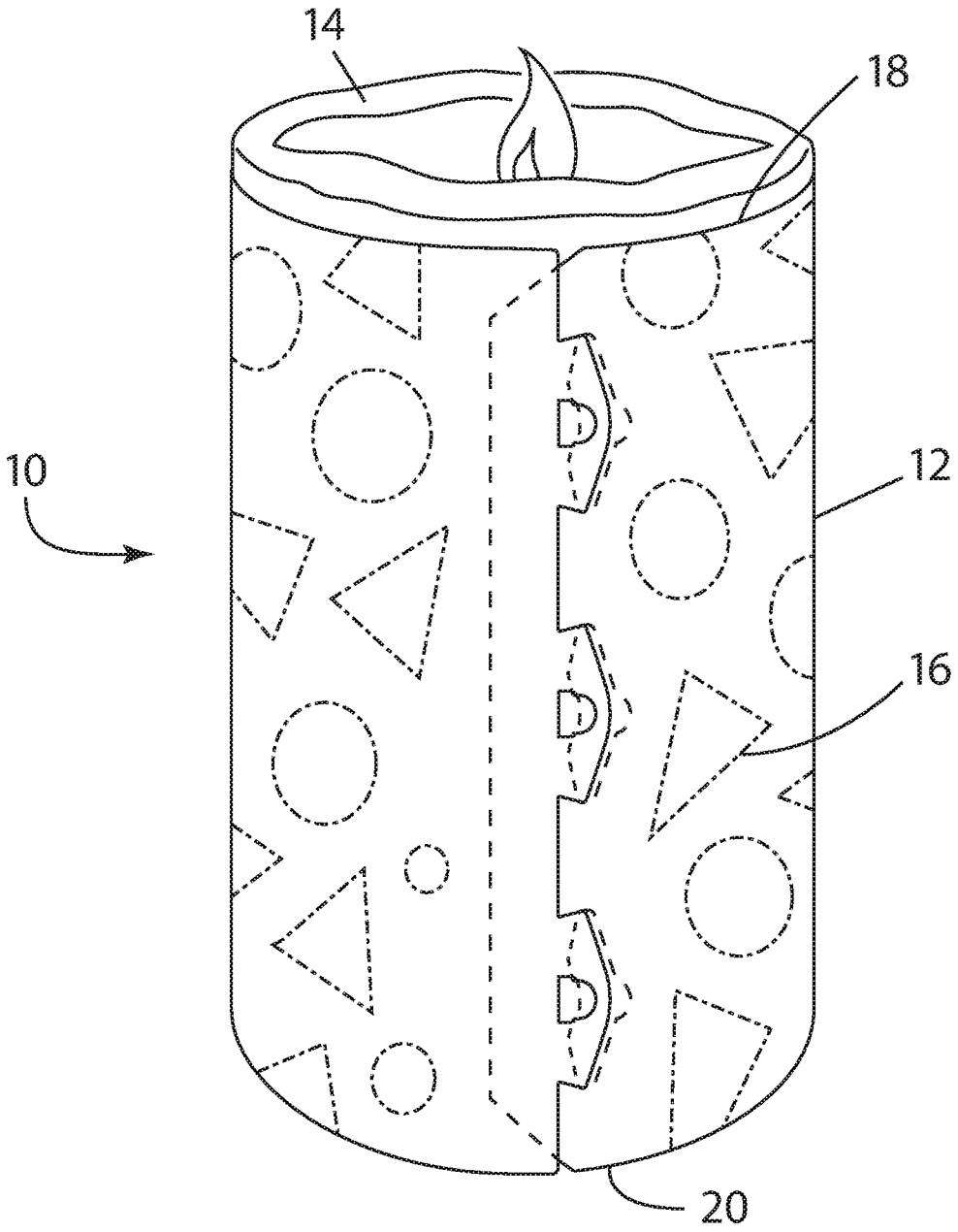
FIG. 1 is a perspective view of a decorative sleeve and candle of the present disclosure.

FIG. 1 illustrates a transparent (and/or translucent) flexible sheet 12 surrounding and covering a candle 14, which is an example of a decorative sleeve 10 of the present disclosure. The sleeve 10 is a substantially cylindrical tube for covering and surrounding a candle 14, the tube having an open top 18 and an open bottom 20. The sleeve 10 includes a flexible sheet 12 that may have a decorative scene or 16 printed or adhered thereon and/or apertures of any size or shape there through. The candle 14 in this embodiment, as well as in other embodiments described herein, may be a traditional flame candle or may be flameless, such as an electric candle like an LED candle. Furthermore, in this embodiment and others described herein, the sleeve may alternatively be used with a light source which is not a candle, such as a bulb.

Figure 2:
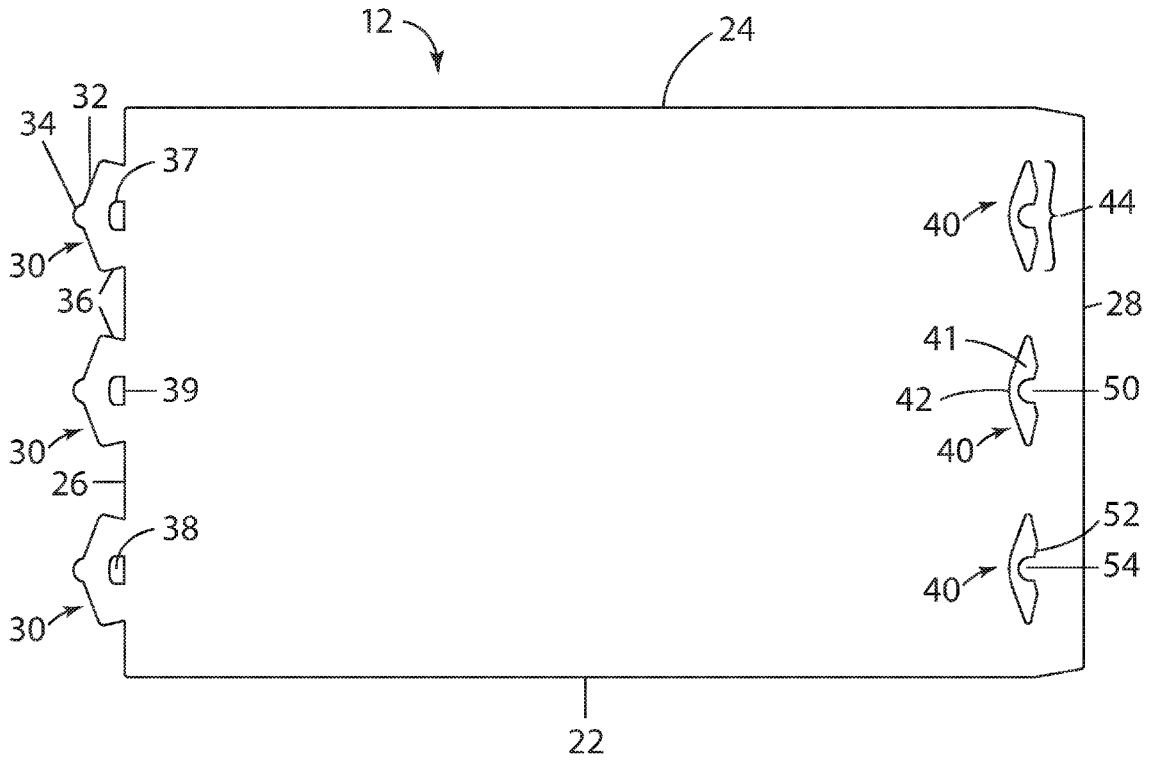
FIG. 2 is a top view of a sheet for use as a decorative sleeve.
Figure 3:
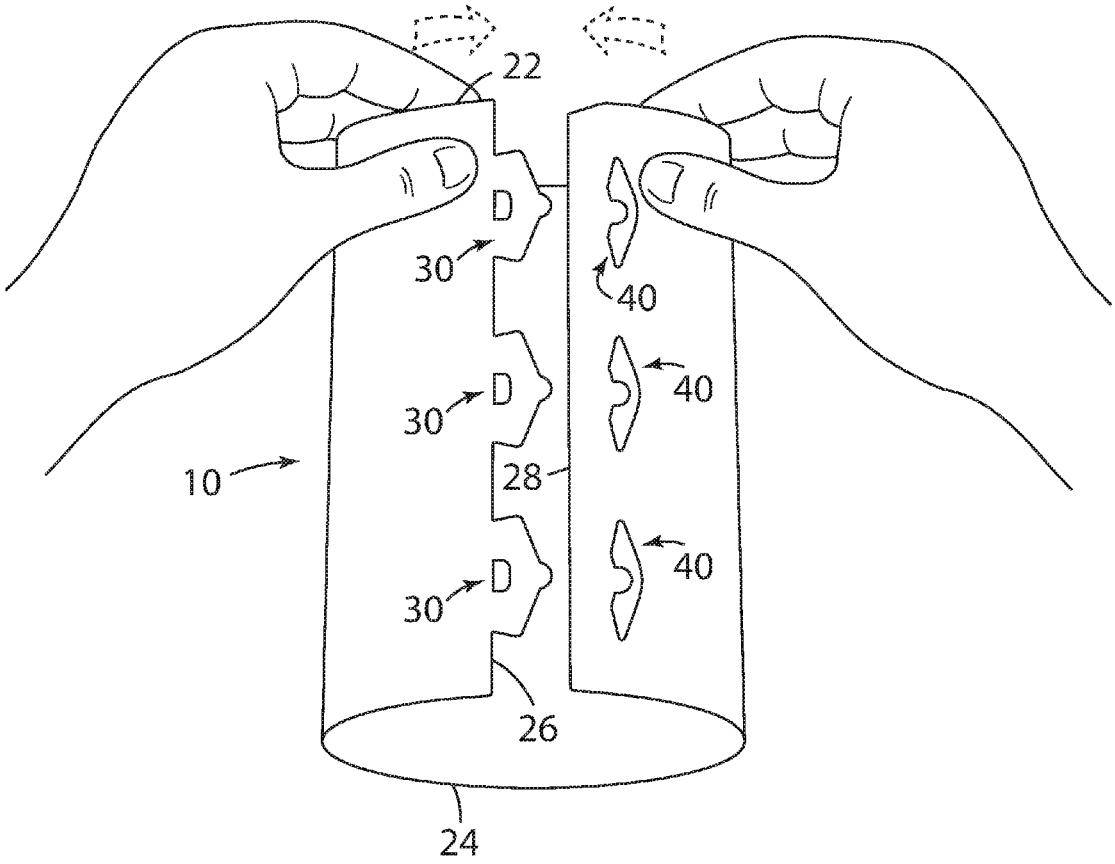
FIG. 3 is a perspective view of a sheet being assembled into a decorative sleeve.

An example of a sheet 12, in an unassembled substantially flat form as during manufacture, shipping, and storage between uses, is shown in FIG. 2. The sheet 12 is generally rectangular in shape, having an upper edge 22 and an opposing lower edge 24. The sheet 12 further includes a first side edge 26 and an opposing second side edge 28. As shown in FIG. 3, the side edges 26, 28 are brought together and then connected to form the sheet 12 into a cylindrical tube 10.

The sheet 12 is produced from a flexible material, where the material may also be transparent and/or translucent. That is the material may be clear and/or may allow the transmission of some but not all light. For example, the sleeve 10 may be produced from a plastic film or sheet having a thickness sufficient to allow the sheet structural integrity with an adequate degree of flexibility such that the sheet 12 and the scene 16 are not distorted, torn or cracked when assembled and covering a candle. Alternatively, other thin and flexible material such as paper maybe used. The sheet 12 is also preferably capable of withstanding heat emitted from a burning candle, a flameless, or another light source with which it is used. The sleeve 10 is sturdy and can retain an upright position when resting on a surface on the top 18 or bottom 20 even when the sleeve is not covering a candle 14.

The sleeve 10 in this example is adapted with an integral decorative scene 16 which may include various images, colors, designs, words and/or phrases printed on or otherwise adhered to the sheet 12. The transparent sheet 12 allows the scene 16 to be illuminated when the candle 14 is lit or illuminated. Further, the sleeve 12 can be adapted with various scenes 16 or messages appropriate for the occasion or season. Alternatively, the sheet 12 may be plain or partially decorated such that a user may create a decorative scene or message, or add to or augment the declarations or messages provided on the sheet 12. For example, the sheet 12 may be provided as part of a kit including materials for a user to decorate the sheet 12 as desired. For example, the kit may include one or more self-adhesive elements such as stickers, gel clings, adhesive jewels, or glitter glue, to name just a few options, and/or may include elements to draw or paint on the sheet 12 such as pens, markers, or paints.

Since some candles such as pillar type candles are large and burn for extended periods of time, and with the prevalence now of flameless candles and other light sources that can be used for years, the sleeve 10 of the present disclosure is configured for removal, storage, and later reuse. The open top 18 and open bottom 20 of the sleeve 10 also allow a user to replace or change decorative sleeves 10, which may be changed based on the scene 16 and/or the occasion or current season.

The sheet 12 is configured such that the assembled sleeve 10 is a cylinder having an open space for receiving the candle 14 or other light source. The sheet 12 may be wrapped around the candle 14 and secured in the cylindrical shape. Alternatively, the candle 14 or other light source may be placed in or removed from the space within the tube sleeve 10 by lifting or lowering the sleeve 10 with respect to the candle 14 by open top 18 or open bottom 20.

The sheet 12 may be generally rectangular in shape. Other shapes for the sheet 12 are possible and contemplated and may be used with candles of various heights or dimensions. For example, pillar candles having a cylindrical shape where the height of the candle is closer to the width of the candle may require a square sheet 12. The dimensions of the sheet 12 may be sufficient in width and height or when measured on a diagonal to substantially cover the initial surface are of the candle. As traditional candles burn and tend to lose at least some height, the sleeve 10 may cover the initial size of the candle 14. Alternatively, the sheet may be trapezoidal, having tapering edges, such that the sleeve is conical is tapered (open at both ends) or conical (open at only one end) in shape when rolled formed into a sleeve.

The width of the sheet 12 may allow the assembled sleeve 10 to have a diameter slightly larger than the diameter of the candle 14 or other light source, allowing the sleeve 10 to be easily removable from the candle 14 or other light source (or the candle 14 or other light source easily insertable into space 22 of sleeve 10). Thus, inner facing surface 24 of the sleeve 10 may partially but not fully contact candle 14.

The candle 14 or other light source may fit snugly within the sleeve 10 as shown in FIG. 1, such as when a pillar candle is used. Alternatively, the candle 14 or other light source may be narrower in diameter than the sleeve and both the candle 14 or other light source and sleeve 10 may each rest upon a support surface, such as a table, with a gap between the candle 14 or other slight source and the sleeve 10. In a further alternative, the candle 14 or other light source may be both substantially smaller in diameter and substantially shorter than the sleeve 10, such as when a sleeve 10 that fits snugly around a pillar candle is used instead with a tea light candle. In such an alternative, the entire height of the sleeve 10 would be well illuminated by candle 14 or other light source.

In some embodiments, two or more sheets 12 may be adjoined in series along their connecting edges and formed into a single sleeve. A sleeve formed in this way would have a larger diameter than one formed from an individual sheet. In this way, the size of the sleeve may be adjusted by interconnecting a plurality of sheets, each of which could alternatively be used individually, in order to create a sleeve of the desired larger size.

The sheet 12, which is assembled to form sleeve 10, may be produced from a larger web of material where the web is plain or is printed with a selected design or images and later cut for each individual sleeve 10. Any one of various processes for printing or otherwise applying the design to the sheet material and cutting the sheet 12 for each sleeve 10 may be used. In some embodiments, ink may be applied directly to the sheet, such as by using an ultraviolet press. Alternatively, a decorative design may be applied to the sheet using etching, laser, embossing/debossing, stickers, vinyl, or other techniques on the sheet. In some embodiments, the decorative design may include textured printing, such as a buildup of layers both matt and glossy material of the same color, with some of each the matt and the glossy material at the surface to create an illusion of texture which may give it a hand painted appearance. In still other embodiments, the decorative design may be applied to a substrate, such as a translucent and/or transparent substrate, which may be adhered to the sheet. The larger sheet of a transparent and/or translucent material having the decorative design applied thereto, either directly or indirectly, may be cut by die cutting or other processing methods, into individual sheets 12.

Some decorative designs include cut out elements that form apertures of various shapes within the sheet 12. For example, the decorative design may include a face having eyes, and the eyes of the face may be formed by apertures within the sheet 12. Other types of apertures are also contemplated, such as snowflake shapes, stars, or any other shape. These apertures may be cut out of the sheet 12 at the time that the individual sheets 12 are cut from the larger sheet of material. Since the light can pass through such apertures without obstruction by the sheet, they can appear brighter and/or may be a different color than the light shining through remainder of the sleeve 10, such as if the body of the candle 14 is visible through the aperture. In some embodiments, the upper and/or lower edges 18, 20 may include cut out portions such that the edges 18, 20 are irregular rather than straight, as a component of the decorative design.

In an alternative embodiment, a sleeve 10 may comprise two or more overlapping sheets 12, inside of each other. The sheets 12 may each be adapted with a different decorative image or scene 16 or apertures which may correspond to one another to form a composite scene 16. The sleeve 10 may comprise two sheets 12, each forming a cylindrical tube. A first, inner sheet 12 may have a cylindrical tube diameter that is greater than the diameter of the candle 14. A second, outer sheet 12 would then have a cylindrical tube diameter that is greater than the diameter of the first sheet. For example, the outer sheet 12 may be only slightly larger than the inner sheet 12 such that the sheets 12 abut each other when put together as a sleeve, or it may be slightly larger forming a small gap between the sheets 12, or may be large enough to form a large gap between the sheets 12 when formed into a layered multipart sleeve 10. The sheets 12 may then be layered to form the sleeve 10 having a decorative scene 16 that is a composite scene, having a dimensional effect. The sheets 12 may each have a same or different sizes, including different heights or have different perimeter shapes as well as different decorative images or scenes.

In some embodiments, the sheet 12 is made of a colorless opaque plastic which simulates the appearance of clear frosted glass. The sheet 12 may have one smooth surface and one rough surface. In order to more realistically simulate frosted glass, the rough surface may be oriented outward when the sheet 12 is formed into a sleeve 10. However, such a rough surface may not provide a good substrate for printing, therefore it may be preferable to print the decorative design on the smooth inner surface of the sheet 12. In such embodiments, the decorative design may be reverse printed on the inner surface in order to achieve the proper image orientation when the sheet 12 is used as a sleeve 10. For example, if words are printed onto the inner surface of the sheet 12, the words and letters may be printed backward so that they appear to have a normal, left to right orientation when viewed through the sheet 12 after the sheet 12 is assembled into a sleeve 10. Likewise, the orientation of any decorative image may be reversed when printed into the inner surface of the sheet 12 to achieve the desired orientation when the sheet 12 is rolled into a sleeve 10 and the image is seen through the sheet 12.

In some embodiments, the material used for the sheet 12 may be lenticular, such as a lenticular plastic. For example, the sheet 12 may be a plastic having a smooth surface which may be oriented toward the inside when formed into a sleeve 10, and an opposing lenticular surface having a plurality of lenticular lenses. A plurality of interlaced images may be used for decorating the sleeve, which may be printed on the smooth surface of the sheet 12 or may be printed on a substrate and applied to the sheet 12. The use of lenticular material may allow for the decorative elements of the sleeve 10 to appear 3 dimensional or to appear to change or move when an observer moves with respect to the sleeve 10. For example, the interlaced decorative elements and the lenticular lenses may be oriented around the sleeve 10 such that, when the sleeve 10 is in use and resting on a horizontal surface, as an observer walks past or around the sleeve 10, the decorative elements appear to change or move in an appropriate manner. This may be achieved by orienting the lenticular lenses vertically in the sleeve 10, for example.

A further optional alternative with any embodiment is the use of a scented material as a component of the sheet 12. For example, the ink used to print a decorative scene may be scented. Alternatively, the material of the sheet 12 itself may be scented. An example of a scented material that may be used in various embodiments is the scented cellulosic plastic known as AURACELL which is commercially available from Rotuba Extruders of Linden, N.J., and which is described in U.S. Pat. No. 7,741,266. Other scented plastics or papers may alternatively be used. Such materials may continuously release a scent over time. The scent used in the sheet 12 may be coordinated with the scene itself, such as the use of a pine scent for a winter scene.

The sheet 12 is adapted along at least one side length for securing the assembled sleeve 10 in the cylindrical shape. The sheet 12 may be adapted with a clasp (not shown) or an adhesive strip along one side length (not shown) for securing the assembled sleeve 10. In the embodiment shown in FIGS. 1-5, the sheet includes an interlocking mechanism, described further below. Other securing mechanisms may be used or incorporated as well. This allows a user to quickly assemble the sleeve 10 prior to use with the candle 14. The interlocking mechanism used to secure the sheet 12 into a sleeve 10 results in a smooth, releasable connection of the edges of the sheet 12 that does not result in buckling of the sheet 12.

In the interlocking mechanism shown, the first side edge 26 includes a plurality of first locking members 30 and the second side edge 28 includes a plurality of second locking members 40. The locking members 30, 40 of each side edge 26, 28 are aligned and configured to smoothly, securely and releasably mate together to interconnect the side edges 26, 28.

The first locking member 30 is a tab that extends outward from the first edge 26. The first locking member 30 includes a leading edge 32, furthest from the first edge 26 of the sheet 12. The leading edge 32 includes a tip 34 and tapers back toward the first edge 26 of the sheet 12. In this example, the tip 34 is rounded and semicircular, but the tip 34 could alternatively simply be a rounded or hard angle and/or the leading edge 32 could be rounded or straight across its length. The first locking member 30 also includes opposing edges 36 that extend directly from the first edge 26 of the sheet 12 to the leading edge 32 of the tab. In this example, the edges 36 are angled away from each other slightly as they extend from the first edge 26. Alternatively, the edges 36 may be parallel to each other and perpendicular to the first edge 26, or may angle toward each other as they extend from the first edge 26. There is a single aperture 38 within the first locking member 30. In this embodiment, the aperture is semicircular in shape, forming a half circle, with an edge 37 and a base 39 that is aligned with the first edge 26 of the sheet 12, though other shapes are possible.

The second locking member 40 is located within the body of the sheet 12, adjacent to the second edge 28. It is formed by an elongated aperture 41 within the sheet 12, extending lengthwise parallel to the second edge 28. The aperture 41 includes an inner edge 42 farthest from the second edge 28 and an opposing outer edge 44 closest to the second edge 28. The inner and outer edges 42, 44 come together in a rounded acute angle at the ends of each aperture 41. In alternative embodiments, where the inner and outer edges 42, 44 come together at each end of the aperture 41, a linear slit may extend away from the aperture 41, forming a continuation of the length of the aperture 41. The slit may be narrower than the aperture 41, and there may be no gap in the material of the sheet 12 within the slit or there may be a small gap to more easily accommodate the thickness of the sheet 12 when the locking members 30, 40 are connected. The length of the aperture 41, including any slits (if present) may be only slightly greater than the width of the first locking member 30 from edge 36 to edge 36, to allow the first locking member 30 to fit snugly into the aperture 41.

In the embodiment shown, the inner edge 42 is curved (C-shaped) and extends away from the aperture 41. The outer edge 44 angles away from the aperture 41 at its edges. However, more centrally within the aperture 41 the outer edge 44 reverses direction and extends into the aperture 41 to form a tab portion 50 projecting within the aperture 41. The tab portion 50 includes a tab edge 52 that tapers outward into the aperture 41 to form a tab tip 54. In the embodiment shown, the tab tip 54 is rounded and semicircular, but the tip 54 may alternatively be a rounded or hard angle.

Figure 4:
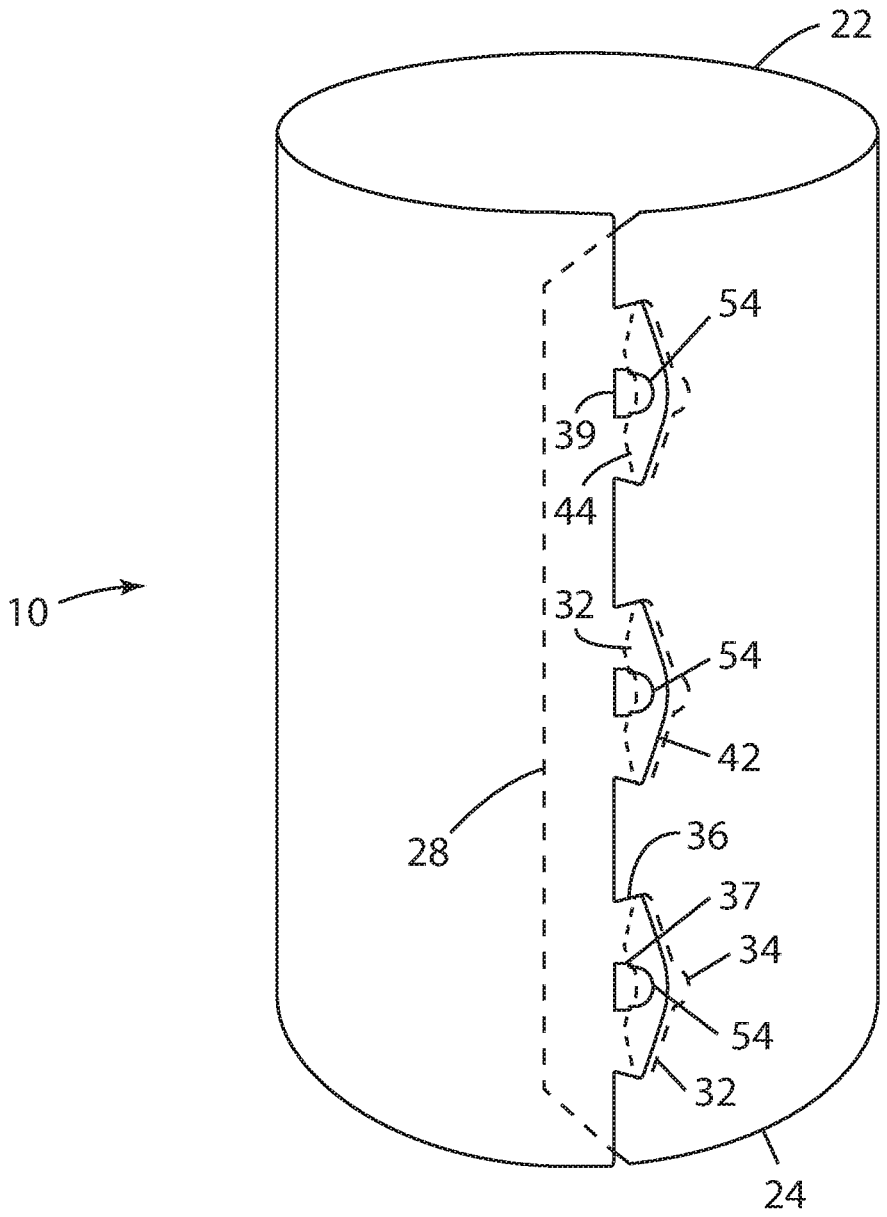
FIG. 4 is a perspective view of a decorative sleeve.
Figure 5:
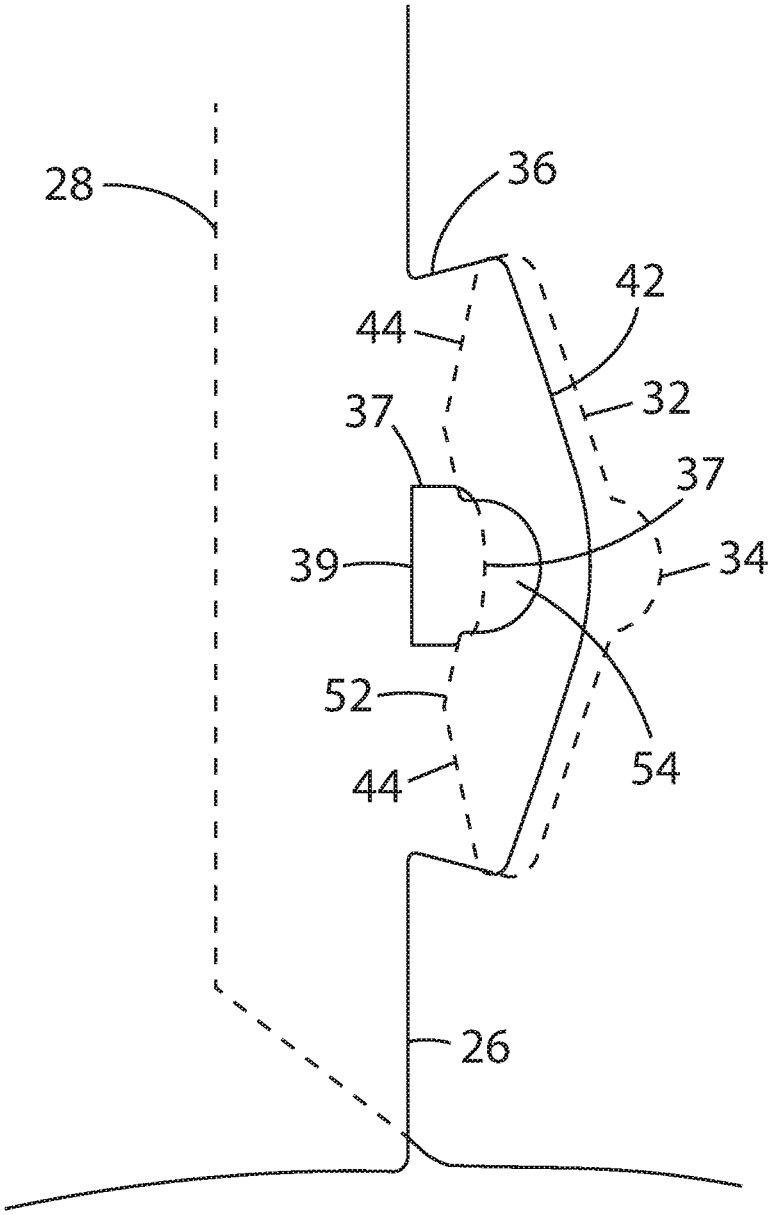
FIG. 5 is a close up view of a first and second locking member of the decorative sleeve in a locked configuration.

When the first and second locking members 30, 40 are interlocked as shown by the arrows in FIG. 3, the members 30, 40 mate as shown in FIG. 4 and in the close up shown in FIG. 5. This is achieved by rolling sheet 12 into a tube and sliding the first locking member 30 past the second edge 28 on the outer surface of the sheet 12 and into the aperture 41. The leading edge 32 inserts into the aperture 41 to lie against the inner surface of the sleeve 12. This action is assisted by the tapering of the leading edge 32 and the roundness of the tip 34 as well as the roundness of the inner edge 42. In alternative embodiments, the first locking member 30 may be wider than the aperture 41, and may extend through the slits at the edges of the aperture 41.

Once the first locking member 30 is inserted sufficiently far into the aperture 41, the tab tip 54 of the tab portion 50 of the second locking member 40 can extend from behind the first locking member 30 through the aperture 38 of the first locking member 30. In this position, the tab tip 54 is in front of the first locking member 30, with the edge 37 of the aperture 38 behind the tab tip 54. In this way, the edge 37 of the aperture 38 abuts the tab edge 52 adjacent to the tab tip 54, securing the first locking member 30 in position within the aperture 41 and preventing it from sliding out and locking the two members 30, 40 together. To release the members 30, 40 the tab tip 54 can be pushed back through the aperture 38, owing to the flexibility of the sheet material, and the members 30, 40 can be slid apart. In this way the members 30, 40 retain their shapes and functionality so that they can be easily reengaged again later.

The design of the first and second locking members 30, 40, which may include nothing but the sheet material itself, allows them to easily slide together and lock into place, yet also allows them to separate easily and be used over and over again. Because of this, the first and second locking members 30, 40 can be used in any application to connect one sheet to another to form a continuous smooth plane. For example, they may be used to releasable close an envelope, a box such as a take-out food box.

Alternatively, the first and second locking members 30, 40 can also be used to connect first and second sheets in a perpendicular arrangement. Examples of such include planar elements inserted into a horizontally oriented base, so that the planar elements are able to stand vertically, though other orientations are also possible. The sheet that forms the base includes a space or gap beneath the sheet to allow insertion of the locking member through the base and perpendicular alignment.

Figure 6:
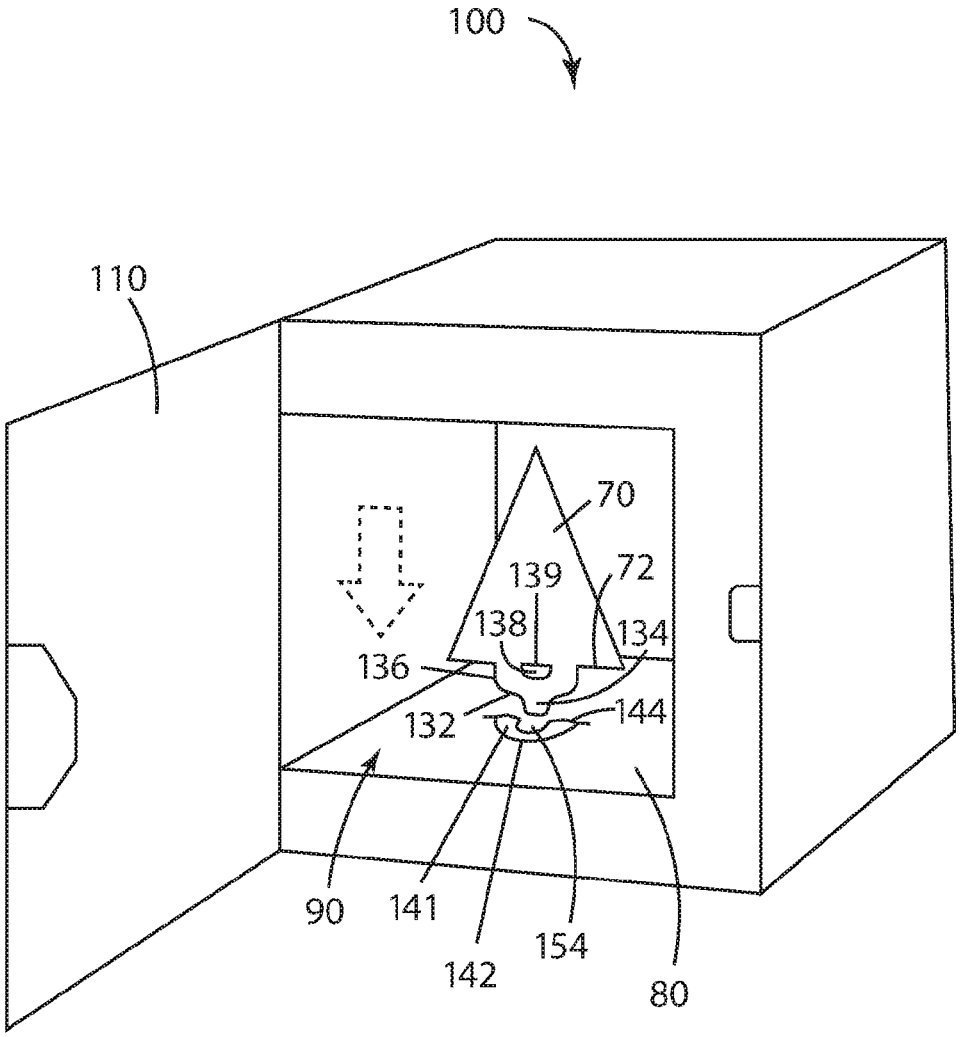
FIG. 6 is a front perspective view of a diorama including a first sheet for locking into a second sheet in the base.
Figure 7:
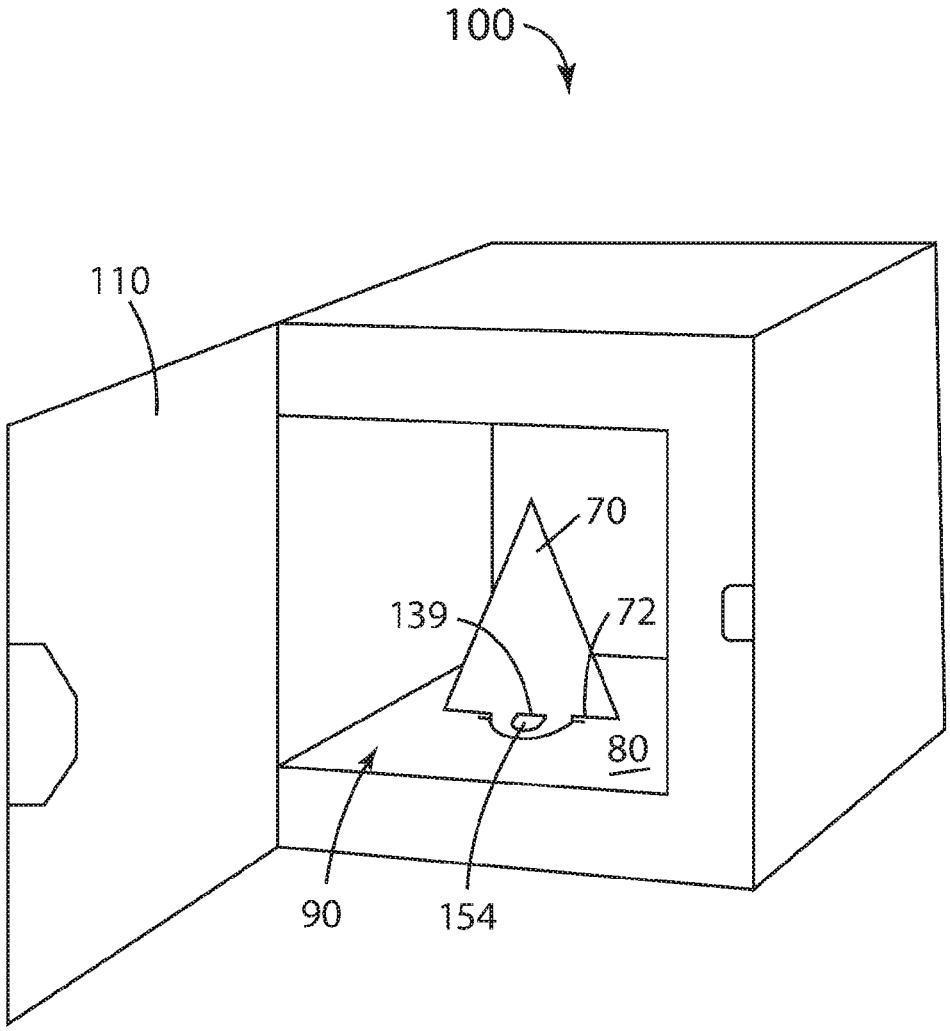
FIG. 7 is a front perspective view of the diorama with the first sheet interlocked with the second sheet in a base.
Figure 8:
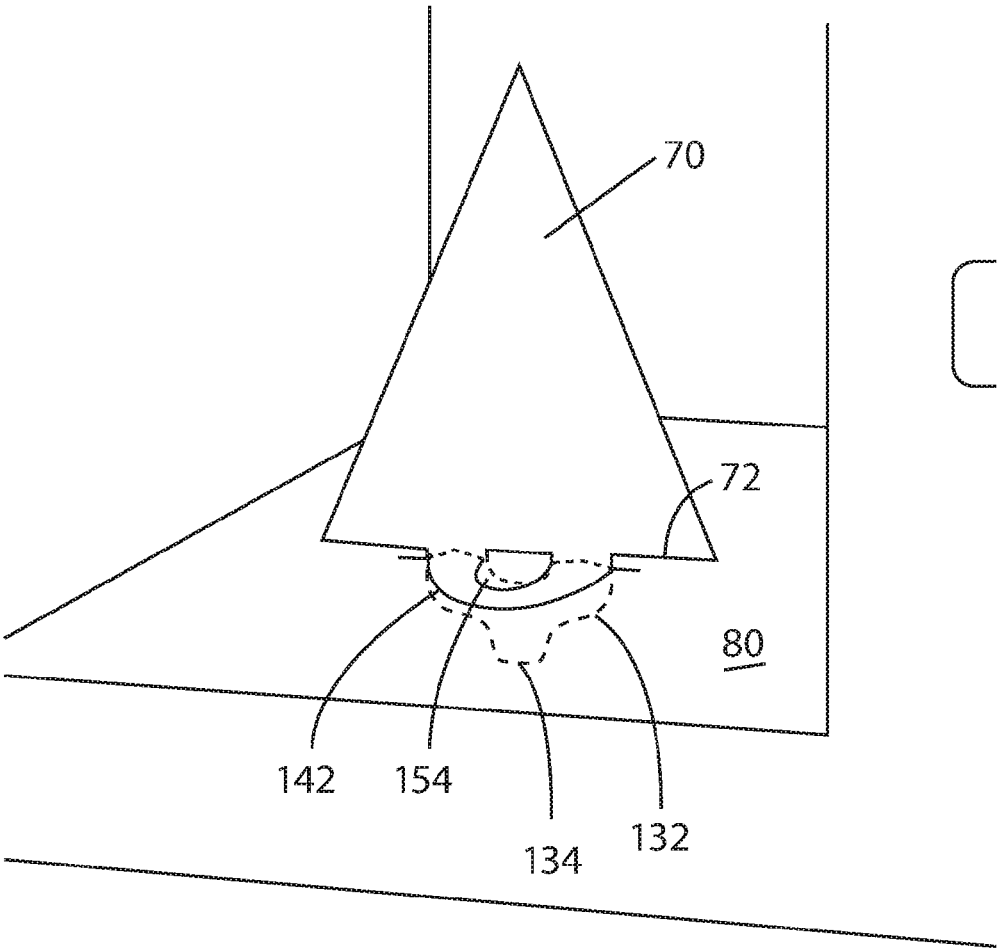
FIG. 8 is a close-up view of the interlocked first and second sheet of FIG. 7, with a partial see-through to show the first locking member beneath the second sheet.

An example of the use of the locking members in a perpendicular connection is shown in FIGS. 6-8. In this example, there is a first sheet 70 that is planar and in the shape of a tree (though any shape could be used) and a second sheet 80 which forms a base 90. In this example, the first and second sheets 70, 80 are components of a scene within a diorama 100 having a swinging front panel 110 allowing a user to open and view the scene. Although not shown, the scene may include a plurality of other sheets, in the shapes of other trees and/or any other shapes, which may include first locking members like first sheet 70 and which may be inserted into the second sheet 80 through other second locking members. In this way, the scene may include an array of pieces, locked into position using first and second locking members. In some embodiments, diorama 100 may include further enhancements, such as lighting. For example, a light may be located in the base 90 to create the look of a camp fire, and reflective material such as a metal foil may be used inside the diorama 100 such as on one or more inner walls to enhance the fire light effect. Various other scenes may likewise be created.

The first sheet 70 includes a first edge 72, from which the tab shaped first locking member extends. The first locking member includes a tapered leading edge 132 and tip 134 and edges 136 on each of the sides, between the first edge 72 and the leading edge 132. The first locking member further includes an aperture 138 that is semicircular in shape.

Figure 9:
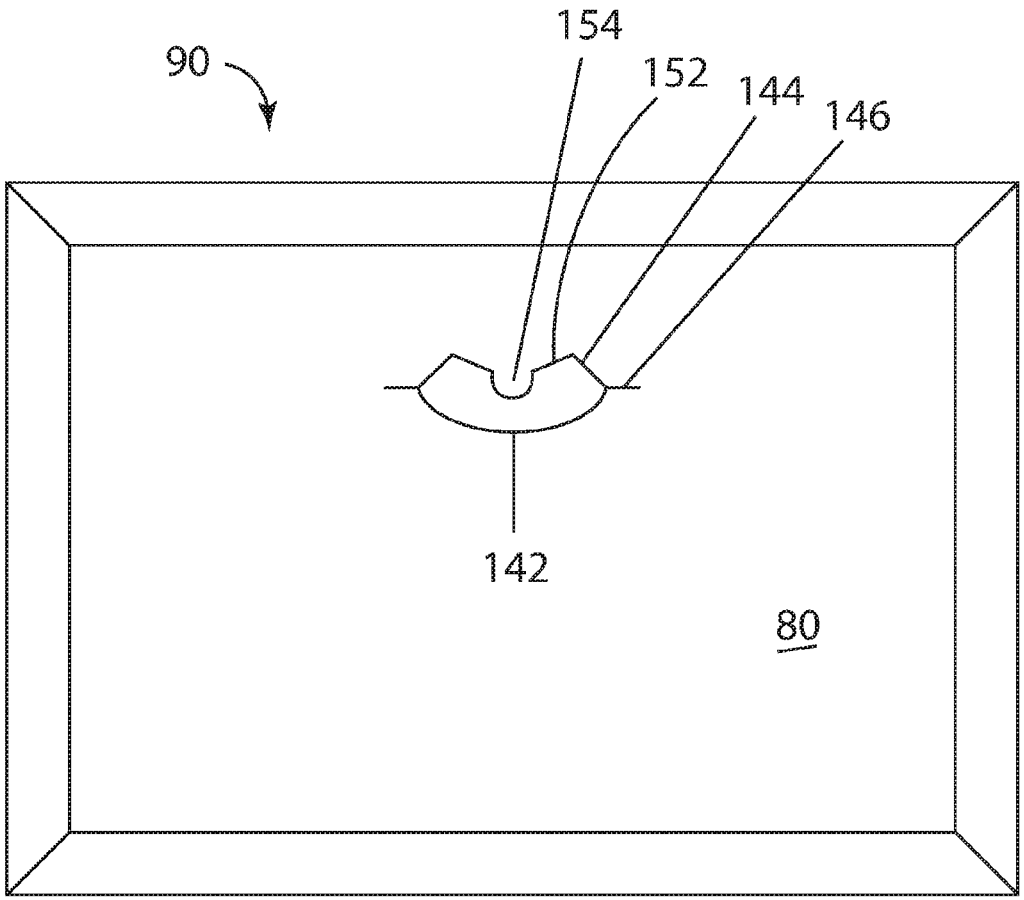
FIG. 9 is a perspective view of the bottom of the base of FIG. 6.

The second sheet 80 forms the top of base 90 and includes a second locking member within it. The second locking member is formed by an elongated aperture 141, which can be further seen in the aerial view of the base 90 shown in FIG. 9. The aperture 141 includes a first edge 142 and an opposing second edge 144. Where the first and second edges 142, 144 come together at each end of the aperture 142, there is a linear slit 146 extending away from the aperture 141.

In the embodiment shown, the first edge 142 is curved (C-shaped) and extends away from the aperture 141. The second edge 144 angles away from the aperture 141 at the edges and more centrally reverses direction and extends into the aperture 141 to form a tab portion 150 projecting within the aperture 41. The tab portion 150 includes a tab edge 152 that tapers outward into the aperture 141 to form a tab tip 154. In the embodiment shown, the tab tip 154 is rounded and semicircular, but the tab tip 154 may alternatively be a rounded or hard angle.

The first locking member can be inserted through the aperture 141 of the second locking member as indicated by the arrow in FIG. 6 in a perpendicular orientation. Once the first locking member is inserted sufficiently far through the aperture 141, the tab tip 154 pops through the aperture 138 to lock it in place as shown in FIG. 7 and hold the sheets in perpendicular orientation. The first locking member is further held in position by the slits 146 which retain the outer edges of the first locking member. The first edge 72 of the first sheet 70 is aligned with the base 139 of the aperture 138. This results in the first edge 72 of first sheet 70 aligning with and abutting the top surface of the second sheet 80, with the first locking member located beneath the second sheet 80, remaining largely unseen by a user within the base 90.

Figure 10:
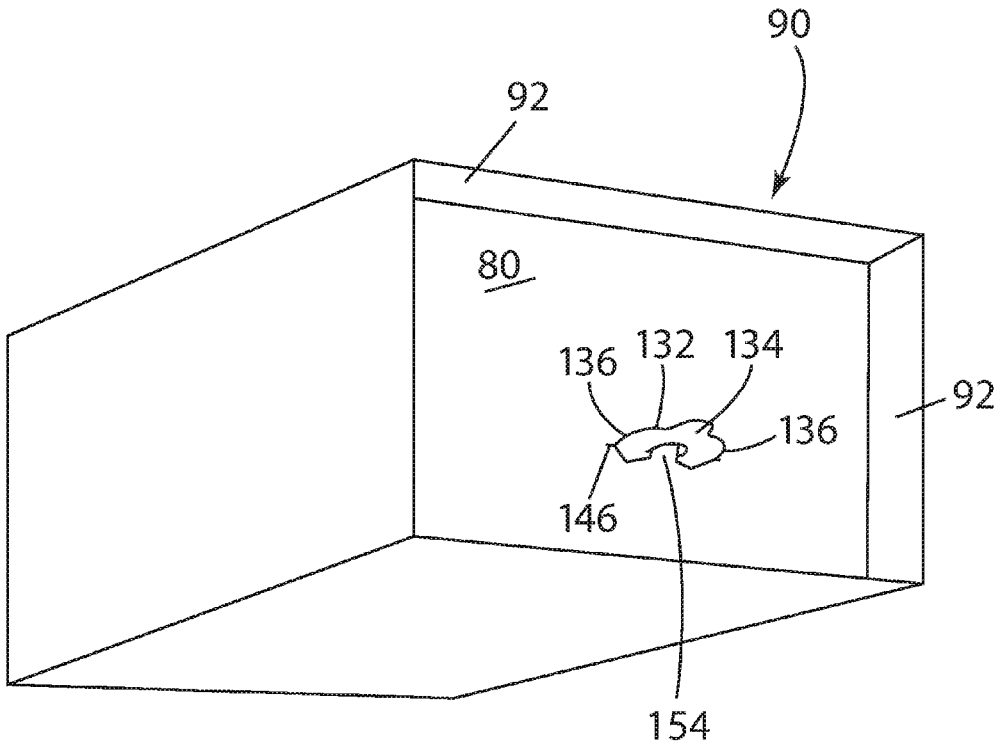
FIG. 10 is a bottom perspective view of the base of FIG. 7.

For further clarification, FIG. 10 is a perspective view of the base 90 from below, showing the first and second locking members in interlocked arrangement. The first locking member can be seen projecting through the aperture 141, with the tab tip 154 of the second locking member extending through the aperture 138 of the first locking member to hold it in place. The sides 92 of the base 90 provide an empty space or gap between the bottom surface of the second sheet 80 and the surface such as a table upon which the base is placed. This allows the first locking member to be inserted through the aperture 141 without obstruction and hides it from view beneath the second sheet 80.

Figure 11:
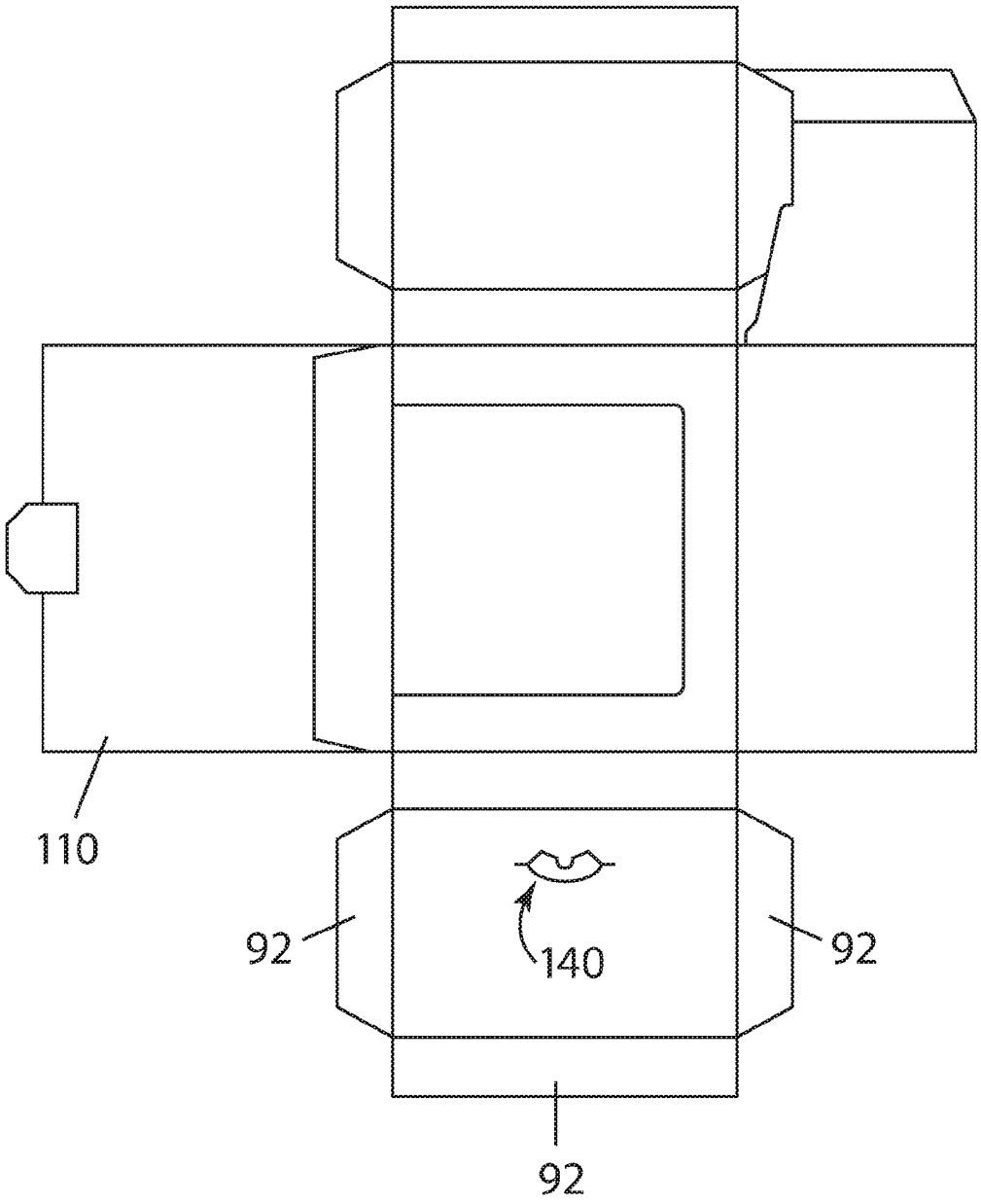
FIG. 11 is a top view of a sheet for folding into the diorama of FIGS. 6-9.

FIG. 11 shows the diorama 100 in a flat, unfolded form, including the second sheet 80, which forms a portion of the base 90, which in turn forms a portion of the diorama sheet, including second locking member 140. The diorama 100 as shown may be folded into the box shaped scene shown in FIG. 6-10, with the first sheet provided separately. The sheets 70, 80 may be any stiff but flexible material, such as a thin plastic or stiff paper material.

In some embodiments, the first and second sheets 70, 80, and optionally additional sheets having a first or second locking members may be provided in a kit for a user to assemble. For example, the kit may form a diorama when assembled with multiple sheets having locking members to insert into a base having corresponding locking members. The kit may further include a book with a story in which the elements of the diorama are featured within the story. For example, the sheets may include one or more characters from the story. In still other embodiments, the kit may provide for insertion of sheets into a base in a designated order and a particular times, such as once per day, in the nature of a calendar such as an advent calendar. Insertion of the sheets by the user may count down the days to a final day which may be particular event such as a holiday, birthday, graduation, first or last day of school, etc., until the project, such as a diorama or other scene, is completed by the user on the final day to mark arrival of that day.

Figure 12:
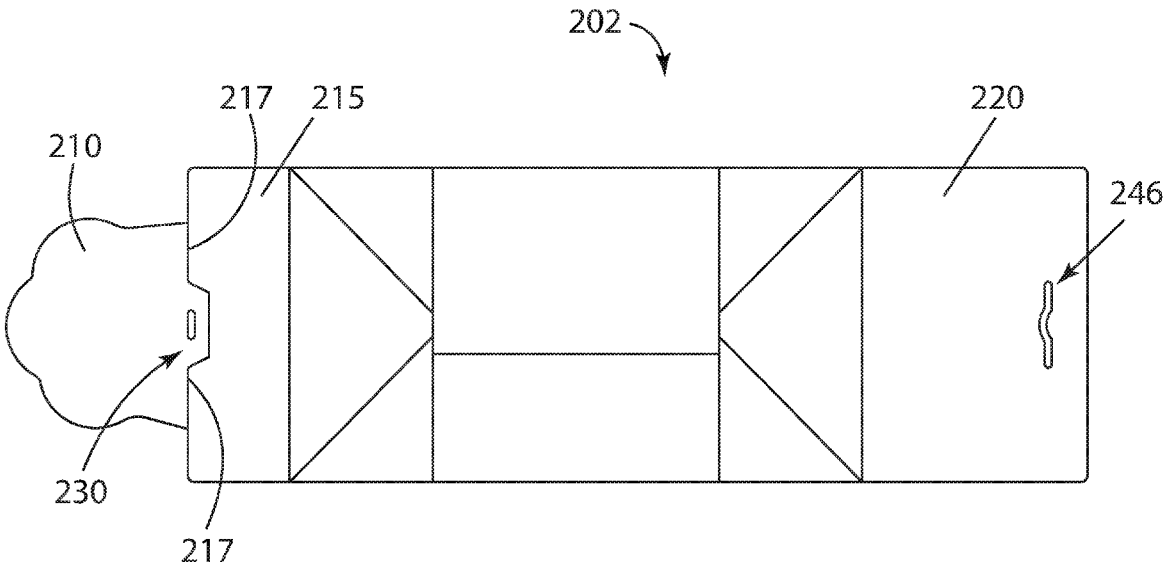
FIG. 12 is a top view of a sheet for folding into the box of FIGS. 13-15.
Figure 13:
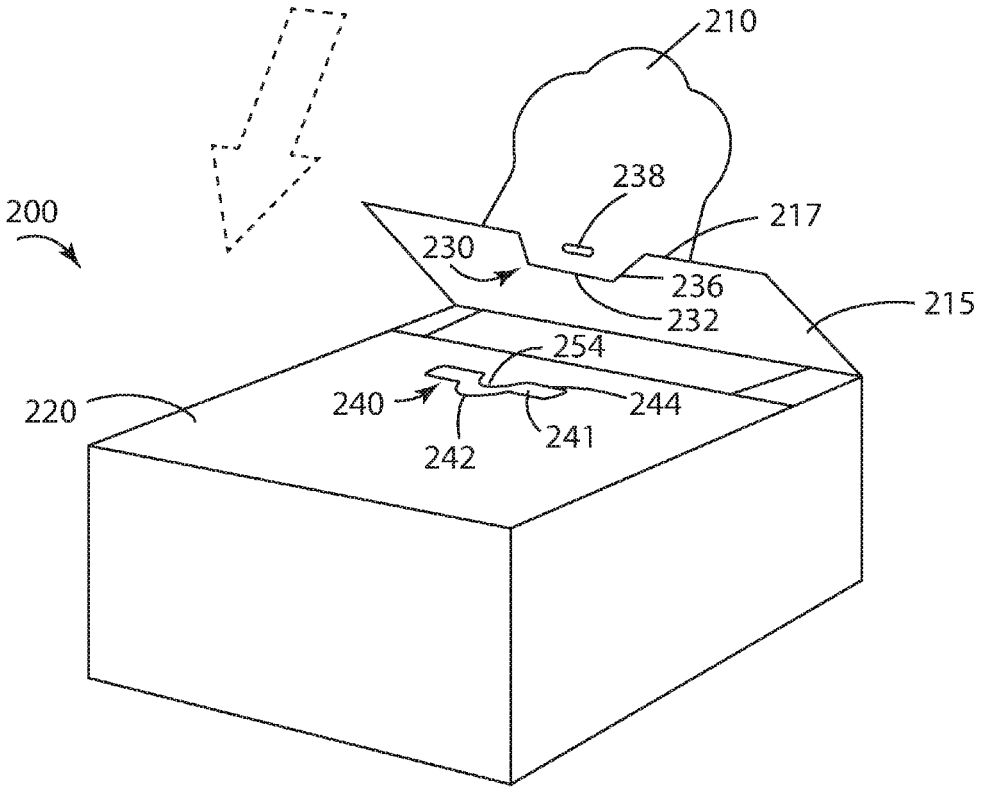
FIG. 13 is a side perspective view of an open box created by folding and adhering the sheet of FIG. 11.
Figure 14:
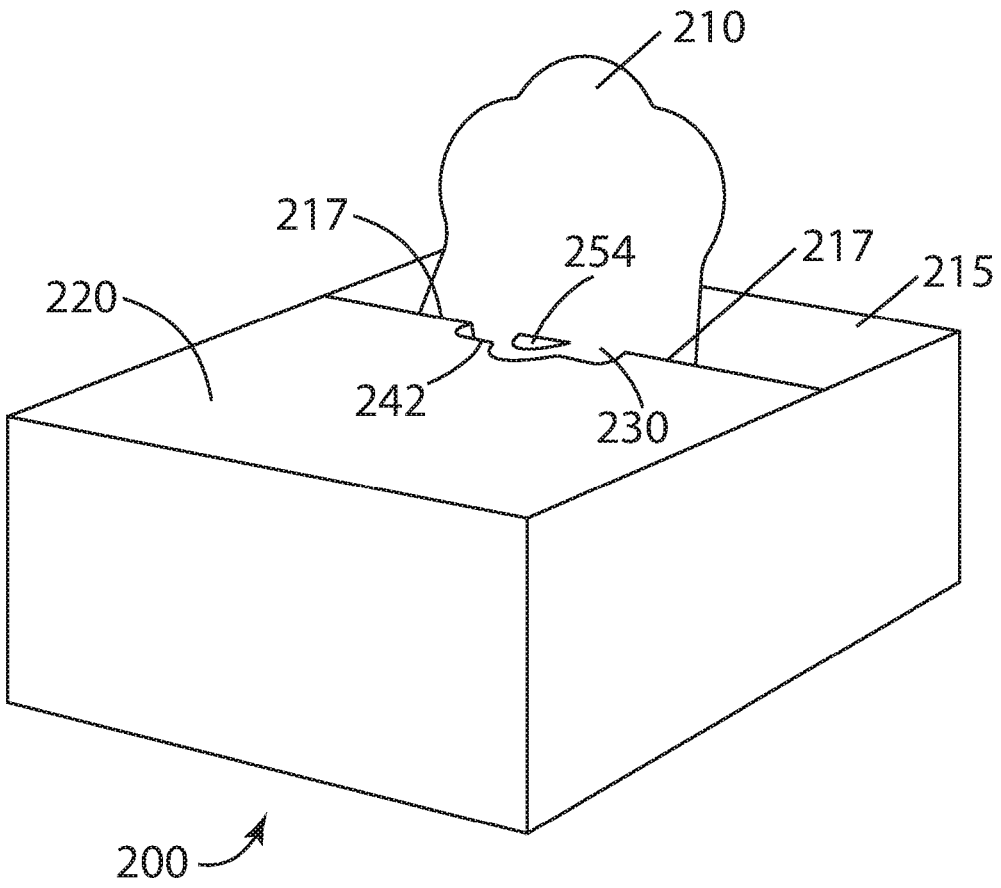
FIG. 14 is a side perspective view of the box of FIG. 12 in closed form.
Figure 15:
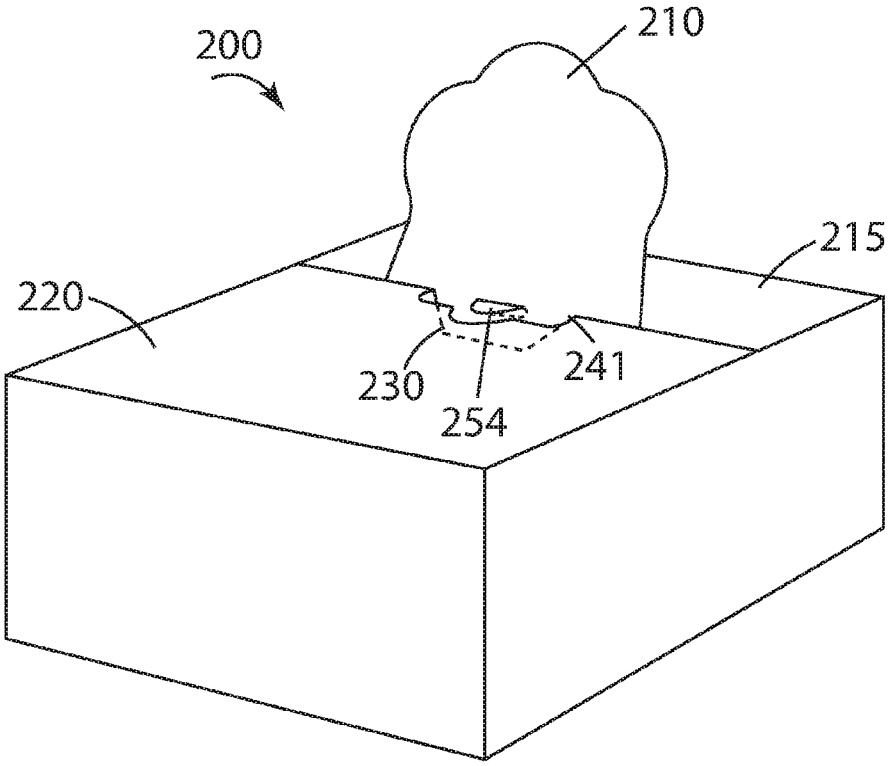
FIG. 15 is a side perspective view of the box in closed form as in FIG. 12 but with a partial see-through to show the first locking member.
Figure 16:
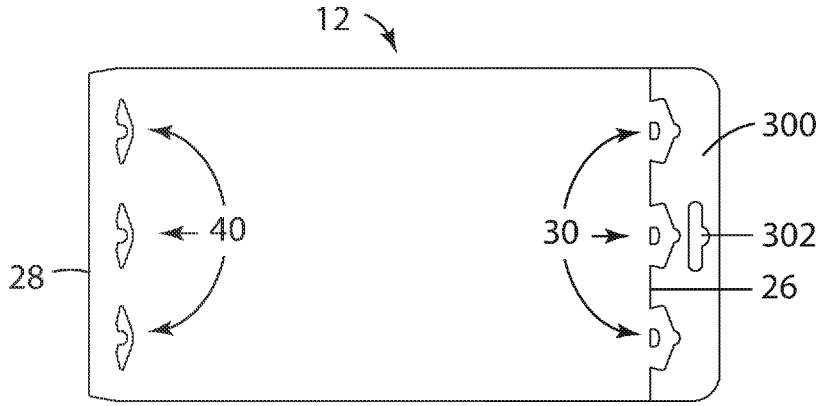
FIG. 16 is a top view of a sheet for use as a decorative sleeve including a detachable portion.
Figure 17:
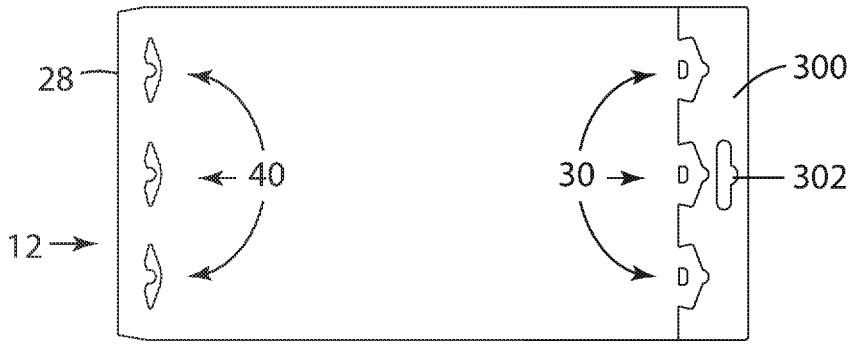
FIG. 17 is a top view of an alternative sheet for use as a decorative sleeve including a detachable portion.
Figure 18:
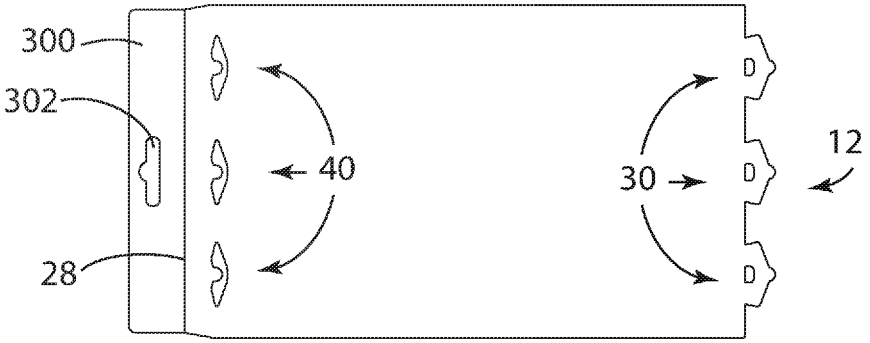
FIG. 18 is a top view of another alternative sheet for use as a decorative sleeve including a detachable portion.
Figure 19:
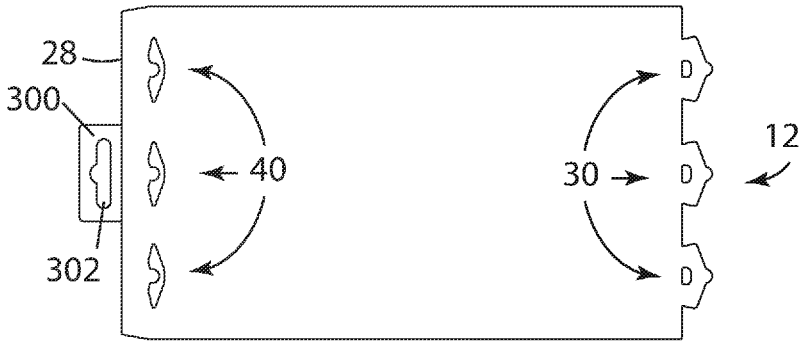
FIG. 19 is a top view of another alternative sheet for use as a decorative sleeve including a detachable portion.

In another example, the first and second locking members may be distinct components of a single sheet, locked together in perpendicular orientation by the locking members. An example of such an embodiment is shown in FIGS. 13-15 which show a box 200 constructed from a single sheet 202 as shown in FIG. 12. The sheet 202 may be any stiff but flexible material, such as a thin plastic or a stiff paper material, depending upon the use of the box 200. When used for carrying food, such as for taking home left overs or for carry-out food or quick service food, the box 200 may be constructed from a water resistant paper material such as a wax coated paper. The box 200 may be formed by folding the sheet 202 and adhering it into a box shape, with the first and second sheet portions 215, 220 loose to allow closure of the box 200 using the first and second locking members 230, 240. The box 200 may include a perpendicular portion 210 which may be shaped into a decorative shape and which may be used for source identification or advertising, for example.

The first sheet portion 215 of the box 200 is connected to the perpendicular portion 210 along a folding line 217, which allows the perpendicular portion 210 to fold relative to the first sheet portion 215. However, the first sheet portion 215 and the perpendicular portion 210 are separated centrally by a cut through the sheet 202 to form the first locking member, bisecting the folding line 217. The first locking member 230 is thus cut out of the first sheet portion 215 and is continuous with the perpendicular portion 210. When the perpendicular portion 210 is folded along fold line 217, the perpendicular portion 210 and the first locking member 230 both turn, relative to the first sheet portion 215, remaining together in the same plane.

In FIG. 13, the sheet 202 has been folded and adhered into a box 200. The perpendicular portion 210 has been folded along fold line 217 upward, away from the box 20, resulting in the first locking member 230 projecting downward, toward the box 200. As the box is closed by moving the first sheet portion 215 downward as shown by the arrow, the first locking member 230 inserts into the aperture 241 of the second locking member 240. Once fully inserted, as shown in FIGS. 13 and 14, the tab tip 254 inserts into the aperture 238, locking the members 230, 240 together, thereby holding the box closed and also holding the perpendicular portion 210 in an upright position, generally perpendicular to the top surface of the box 200. In this example, the perpendicular portion 210 is in the shape of a chef's hat, but any shape could be used.

In the embodiment shown in FIGS. 12-15, it can be seen that the first and second locking members 230 and 240 are shaped slightly differently than in the previous embodiments. It should be understood that the locking members described in the previous embodiments could be substituted for the locking member of this embodiment. Likewise, the locking members of this embodiment could be substituted for those of the previous embodiments.

The first locking member 230 is in a tab shape and includes a leading edge 232 and edges 236 on the sides. The leading edge 232 is flat, with no tapering or tip. However, the edges 236 are tapered such that the tab is narrower at the leading edge and wider at the base, though alternatively the edges 236 could be parallel to each other or could be angles such that the tab is wider at the leading edge 232 than at the base. The first locking member 230 includes an aperture 238, in the shape of an elongated slot.

The second locking member 240 includes an aperture which is an elongated slot 241 having a first edge 242 and a second edge 244. The slot 241 is straight at the periphery and curved centrally. The second edge 244 curves to form a semicircular tab 254. The first edge 242 curves outward in accommodate the shape of the tab 254.

Returning to the sheets 12 for use as candle sleeves 10 as described previously, it may be desirable for a vendor to hang the sheets 12 on a rack in order to display them in a store. Furthermore, it may be desirable to add labeling to the sheets 12 to assist with the sale of the sheets 12, for example. However, it may be preferred if such labeling can be provided without obscuring the decorative scene or leaving any residue on the scene that would interfere with its later use. Therefore, some embodiments may be modified to assist with hanging and labeling of the sheets 12 as described further below and as shown in FIGS. 16-19.

Each of the alternative sheets 12 of FIGS. 16-19 includes a detachable portion 300 with an aperture 302 for purposes of hanging the sheet on a rod of a display rack, such as for displaying the sheets 12 for sale in a store. The detachable portion 300 is not a component of the final decorative sleeve 10. Therefore the connection between the sheet 12 and the detachable portion 300 may be perforated in order to allow a user to easily detach it from the sheet 12. The detachable portion 300 not only allows for the inclusion of an aperture 302 for displaying the sheets 12, but allows for printing or labeling the sheet 12 with printing, stickers, logos, or other labeling or images that may indicate the name, source or price of the product or other information, which may then be removed from the sheet 12 by the user in order to not interfere with the decorative appearance of the sleeve 10.

In some embodiments, the sheet 12 may include guidelines which may be used by a user to reduce the height of the sleeve 10 in order to match the height of a particular candle or other light source. For example, the sleeve 12 may be sized for use with a candle of one height, such as a candle measuring 6 inches tall, and so the sleeve 12 may be sized to stand approximately 6 inches high. However, some users may want to use the sleeve 10 with shorter candles or other light sources, such as candles measuring 5 inches or 4 inches. The user may cut the sheet 12 to reduce the height of the sleeve 10. In order to make this easier, the sheet may include markings which are guidelines to show a user where to cut the sheet 12 to reduce the height of the sleeve 10 for use with standard sized candles, such as one or more of 6 inches, 5 inches, or 4 inches in height. In some embodiments, in order for any decorative imaging to remain centered on the candle or other light source, the sheet 12 may include guidelines for reducing the height of the sleeve by symmetrically removing a portion of the sheet from both the upper edge 22 and the lower edge 24 of the sheet 12.

Figure 20:
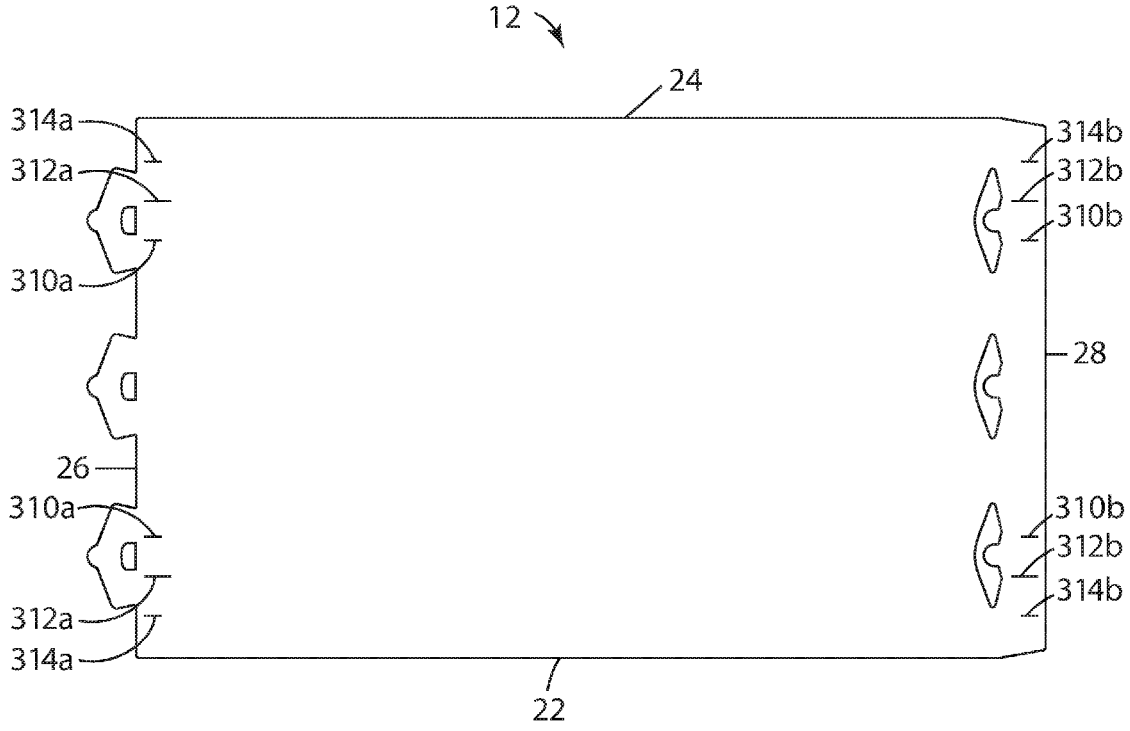
FIG. 20 is a top view of an alternative sheet for use as a decorative sleeve including guideline markings for reducing the sleeve height.

An example of a sheet including size-reduction guidelines is shown in FIG. 20. The guidelines are provided in pairs, adjacent to both the first and second edges 26, 28, to guide a user in cutting the sheet 12 from the first edge 26 to the second edge 28. Furthermore, the guidelines include an upper and a lower pair, for guiding symmetrical removal of equal amounts from the upper edge 22 and the lower edge 24. For example, the two pairs of guidelines 314*a* and 314*b* direct a user to reduce the sleeve by cutting across the sleeve from guideline 314*a* to 314*b*, along both the upper and lower edges 22, 24. To reduce the sleeve 10 to an even smaller height, the user would cut from each guideline 312*a* to the corresponding guideline 312*b*. To reduce the sleeve 10 to a still smaller height, the user would cut from each guideline 310*a* to the corresponding 310*b*. In this way, the guidelines direct a user in where to cut the sheet 12 as needed to symmetrically reduce the height of the final sleeve 10.

The guideline marks may be printed on the sheet 12, such as on the inner surface of the sheet, in the form of a subtle solid, dashed, or dotted line, for example. In some embodiments, the guidelines may not be printed lines but rather may be formed by linear (such as solid, dashed, or dotted) gaps in the decorative printing of the design. The guidelines may be located only at, or closely adjacent to, the first and second edges 26, 28, where they will be less visible, or they may extend partially or completely across the sheet 12.

Although the present disclosure has been described with reference to preferred embodiments, workers skilled in the art will recognize that changes may be made in form and detail without departing from the spirit and scope of the disclosure.

The invention claimed is:

1. A sleeve for receiving or placing around a light source comprising:

a flexible sheet of translucent or transparent material having opposing first and second edges;

a locking system comprising a first locking member adjacent to the first edge and a second locking member adjacent to the second edge, the locking system formed by the sheet and configured to smoothly connect the first and second edges to form the sheet into a sleeve configuration, to disconnect to allow for flat storage of the sheet, and to connect again to form the sleeve configuration at a later time;

wherein the sleeve configuration comprises a self-supporting tubular or conical shape having one or two open ends for placement on a surface and surrounding a light source;

wherein the first locking member comprises a tab extending from the first edge and having an aperture therethrough and the second locking member comprises an elongated aperture extending parallel to the second edge; and wherein the second locking member further comprises a tab projecting into the elongated aperture wherein, when the first locking member is inserted into the elongated aperture of the second locking member, the tab of the second locking member is configured to insert into the aperture of the first locking member, thereby securing the first and second edges together in a smooth overlapping relationship.

2. A system for releasably interlocking a first flexible sheet portion and a second flexible sheet portion, the system comprising:

a first locking member extending from an edge of the first sheet portion, the first locking member having a leading edge, opposing sides, and an aperture therethrough;

a second locking member, formed in the second sheet portion, having an elongated aperture and a tab projecting into the elongated aperture, wherein the first locking member is configured to insert into the elongated aperture of the second locking member; and wherein the tab of the second locking member is configured to insert into the aperture of the first locking member when the first locking member is inserted into the elongated aperture, thereby securing the first and second sheet portions together.

3. The system of claim 2 wherein the first sheet portion and second sheet portion comprises separate sheets, wherein the second sheet portion comprises a base of a diorama and wherein the first sheet portion comprises an element of the diorama, and wherein the locking members connect the first and second sheet portions in a perpendicular orientation.

4. The system of claim 2 wherein the first sheet portion and the second sheet portion form separate portions of a single large sheet, wherein the sheet is folded into a box shape, and wherein the first and second locking members are configured to allow a user to repeatedly open and close the box.

* * * * *